US012419448B1

(12) United States Patent
Oliver

(10) Patent No.: US 12,419,448 B1
(45) Date of Patent: Sep. 23, 2025

(54) BLANKET COZY

(71) Applicant: Victoria Oliver, Lloydminster (CA)

(72) Inventor: Victoria Oliver, Lloydminster (CA)

( * ) Notice: Subject to any disclaimer, the term of this patent is extended or adjusted under 35 U.S.C. 154(b) by 204 days.

(21) Appl. No.: 18/233,354

(22) Filed: Aug. 14, 2023

(51) Int. Cl.
*A47G 9/02* (2006.01)

(52) U.S. Cl.
CPC .... *A47G 9/0261* (2013.01); *A47G 2009/0269* (2013.01)

(58) Field of Classification Search
CPC ..... A47G 9/02; A47G 9/0261
USPC ..... 5/502
See application file for complete search history.

(56) References Cited

U.S. PATENT DOCUMENTS

| | | | | |
|---|---|---|---|---|
| 8,407,836 | B1 | 4/2013 | Sacherman et al. | |
| 10,952,553 | B1 * | 3/2021 | Breon | A47G 9/0261 |
| 11,259,642 | B2 | 3/2022 | Engermann et al. | |
| 2007/0151030 | A1 | 7/2007 | Titcomb | |
| 2007/0245492 | A1 | 10/2007 | Combellick | |
| 2008/0104751 | A1 | 5/2008 | Friedland | |
| 2009/0070933 | A1 | 3/2009 | Hall | |
| 2010/0107339 | A1 | 5/2010 | Stinchcomb | |
| 2013/0180050 | A1 | 7/2013 | Koci | |
| 2015/0366380 | A1 | 12/2015 | Mikesell | |
| 2016/0262557 | A1 | 9/2016 | Williams | |
| 2016/0324342 | A1 | 11/2016 | Khan | |
| 2019/0320807 | A1 | 10/2019 | Backs | |
| 2020/0256011 | A1 | 8/2020 | Jain | |
| 2020/0260886 | A1 | 8/2020 | Chen | |
| 2022/0133052 | A1 | 5/2022 | Adjesson | |
| 2022/0167764 | A1 * | 6/2022 | Elliott | A47G 9/0207 |
| 2022/0248865 | A1 | 8/2022 | Zhou | |
| 2022/0400869 | A1 * | 12/2022 | Teleshevsky | A47G 9/0261 |

FOREIGN PATENT DOCUMENTS

| | | | | |
|---|---|---|---|---|
| DE | 202015101848 U1 * | 6/2015 | | A47G 9/0246 |
| FR | 2895657 A1 * | 7/2007 | | A47G 9/0261 |
| GB | 2481318 A * | 12/2011 | | A47G 9/0261 |
| JP | 2002191483 A * | 7/2002 | | |

* cited by examiner

*Primary Examiner* — Eric J Kurilla
(74) *Attorney, Agent, or Firm* — Cramer Patent & Design, PLLC.; Aaron R. Cramer

(57) ABSTRACT

A Blanket Cozy is composed of a top piece made of sheet material, a bottom portion also made of sheet material, and a separating zipper that serves to separate the two portions. The upper and lower halves of the sheet have the potential to combine and create a protective covering intended for use on a bed. The protective sheet can be designed to secure a quilt, blanket, and/or other bedding, thereby preventing the quilt's upper surface from getting dirty due to user contact. The upper section of the sheet may consist of a quilt pocket designed to cover and secure the upper part of the quilt. The lower section of the sheet may consist of a pocket located in the left corner and another pocket located in the right corner, designed to securely hold the bottom piece of the quilt. The upper section of the sheet can be separated from the lower section using the separating zipper, allowing for laundering and/or replacement in order to alter the aesthetic of the protective sheet.

8 Claims, 2 Drawing Sheets

BLANKET COZY

RELATED APPLICATIONS

None.

FIELD OF THE INVENTION

The present invention relates generally to a bedding cozy and more specifically to a bedding cozy with enhanced features.

BACKGROUND OF THE INVENTION

Sleep is a fundamental component of our existence, and the caliber of our sleep significantly influences our holistic state of health. Traditional bedding frequently presents several difficulties, such as the bothersome displacement and clustering of blankets and quilts, the arduous task of maintaining the cleanliness of the quilt's upper surface, and the restricted range of choices for altering the bed's visual aesthetics.

The inception of the Blanket Cozy arose from the imperative to tackle these concerns and provide individuals with a more enjoyable and convenient nocturnal encounter. The Blanket Cozy is a protective sheet that consists of an upper portion and a lower portion. Once built, these components combine to provide a protective and comfy shell for your bed. The presence of this protective layer serves to maintain the positioning of your bedding, including the quilt, blanket, and other beddings, throughout the duration of the night. As a result, it effectively prevents any displacement and minimizes disruptions, so promoting a tranquil and undisturbed sleep experience.

The upper section of the Blanket Cozy features a blanket pocket. This innovative characteristic effectively envelops and preserves the upper surface of the quilt, serving as a protective shield against the accumulation of dirt, dust, and bodily oils. The use of a top shield by the Blanket Cozy serves to prolong the duration between laundering sessions, hence reducing the amount of effort required and preserving the quilt's pristine aesthetic. The lower section of the Blanket Cozy features pockets located in both the left and right corners. The purpose of these pockets is to effectively secure the lower portion of the quilt, so mitigating the prevalent issue of blankets sliding and gathering at the foot of the bed. The enhanced stability provided by this feature guarantees a clean and pleasant sleeping surface.

The Blanket Cozy is designed with a dividing zipper mechanism, facilitating the uncomplicated detachment of the top portion of the sheet from the bottom portion. This feature facilitates the process of laundering, so ensuring the maintenance of cleanliness and hygiene for your bedding. Furthermore, the capacity to substitute the upper section of the sheet provides individuals with the flexibility to modify the aesthetic of the protective covering, so enabling a rejuvenated and modernized appearance for their bedding. Given the aforementioned issues and considering the conventional bedding options with the advantages of the Blanket Cozy, it can be argued that the Blanket Cozy signifies a notable and novel advancement in bedding technology, presenting an unprecedented combination of comfort and functionality that surpasses that of typical bedding materials.

SUMMARY OF THE INVENTION

Embodiments of the present disclosure may include a blanket cozy device including a sheet top portion. Embodiments may also include a sheet bottom portion. Embodiments may also include a separating zipper. In some embodiments, the sheet top portion and the sheet bottom portion form a protective sheet for use on a bed.

In some embodiments, the protective sheet may be configured to hold a quilt, blanket, and/or other bedding in place and prevent the top of the quilt from becoming soiled by a user. In some embodiments, the sheet top portion may include a quilt pocket configured to cover and retain the top of the quilt. In some embodiments, the sheet bottom portion may include a left corner pocket and a right corner pocket configured to retain the bottom of the quilt.

In some embodiments, the sheet top portion may be detachable from the sheet bottom portion at the separating zipper for laundering and/or replacement to change the appearance of the protective sheet. In some embodiments, the sheet top portion may be a rectangular fabric panel that can be folded in half to define a rear panel and a front panel, with lateral edges sewn together to form the quilt pocket. In some embodiments, the top rear of the sheet top portion may include a personal items pocket, configured to store one or more personal items, such as a smartphone, and secured by a personal items zipper.

In some embodiments, the personal items pocket may be divided into a left side and a right side by an internal sewn wall, accessible by opening the personal items zipper. In some embodiments, the sheet top portion may be made from materials such as silk, faux fur, or other soft materials, suitable for contacting a user's face.

In some embodiments, the sheet bottom portion may be a rectangular fabric panel including the left corner pocket and the right corner pocket, configured to retain the bottom corners of the quilt. In some embodiments, an individual corner pocket from the left corner pocket and the right corner pocket may be a fabric panel in the shape of an isosceles right triangle, coupled to the sheet bottom portion along two edges to accept a corner of the quilt. In some embodiments, the sheet bottom portion may be made from materials such as cotton, fleece, bamboo, polyester, linen, microfiber, or satin.

In some embodiments, the separating zipper may include a first zipper half coupled to the bottom of the rear panel and covered by a material flap to prevent contact with the user. In some embodiments, the separating zipper may include a second zipper half coupled to the top of the sheet bottom portion. In some embodiments, the separating zipper enables the sheet top portion to be removed from the sheet bottom portion.

In some embodiments, the sheet top portion may be available in an assortment of materials, colors, designs, or any combination thereof, allowing for mix and match features to alter the appearance of a bed. The blanket cozy may further include one or more hook-and-loop fasteners optionally used to assist in retaining the top of the quilt in the quilt pocket.

In some embodiments, the hook-and-loop fasteners may include a hook portion coupled to the inside of the quilt pocket and a loop portion coupled to the top of the quilt for engagement and retention. In some embodiments, the quilt pocket may be configured to protect and retain the top of the quilt, preventing it from shifting during use. In some embodiments, the left corner pocket and the right corner pocket may be configured to securely hold the bottom corners of the quilt, ensuring it remains in place on the bed.

BRIEF DESCRIPTION OF THE FIGURES

The advantages and features of the present device will become better understood with reference to the following more detailed description and claims taken in conjunction with the accompanying drawings, in which like elements are identified with like symbols, and in which:

DESCRIPTIVE KEY

Figure 2:
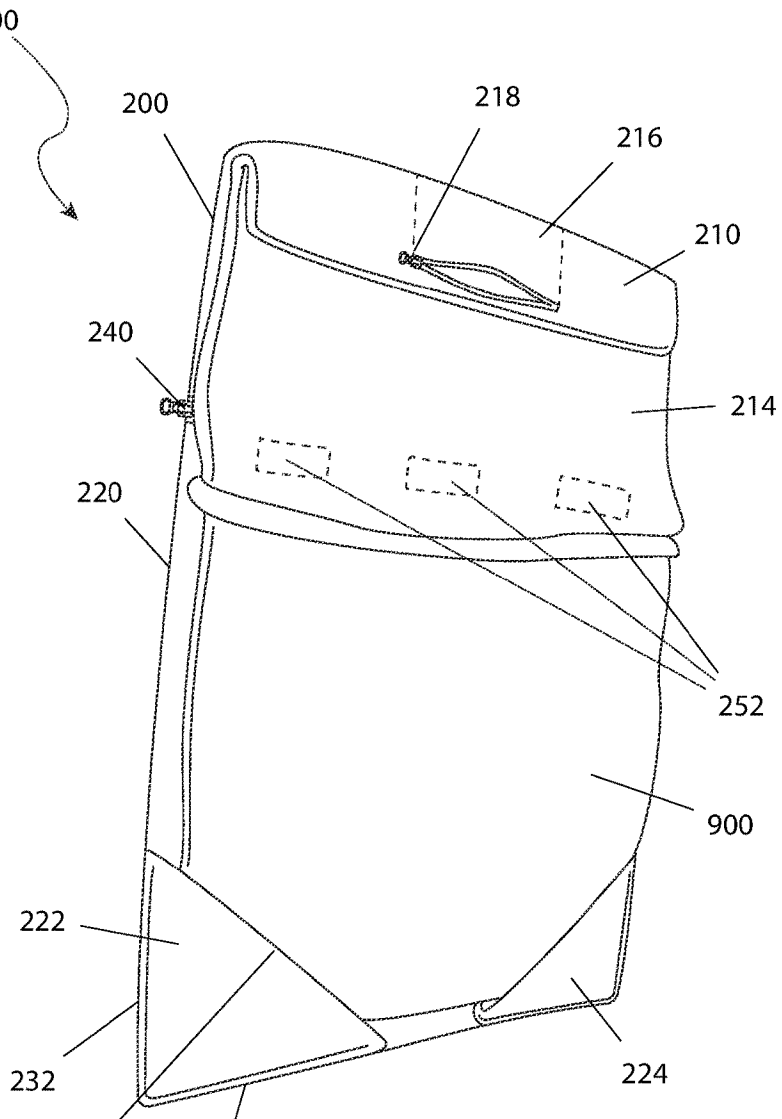
FIG. 2 is an isometric view of a blanket cozy 100, according to an embodiment of the present device, illustrating the sheet top portion 200 folded forward to show the rear panel 210 and the personal items zipper 218.
Figure 1:
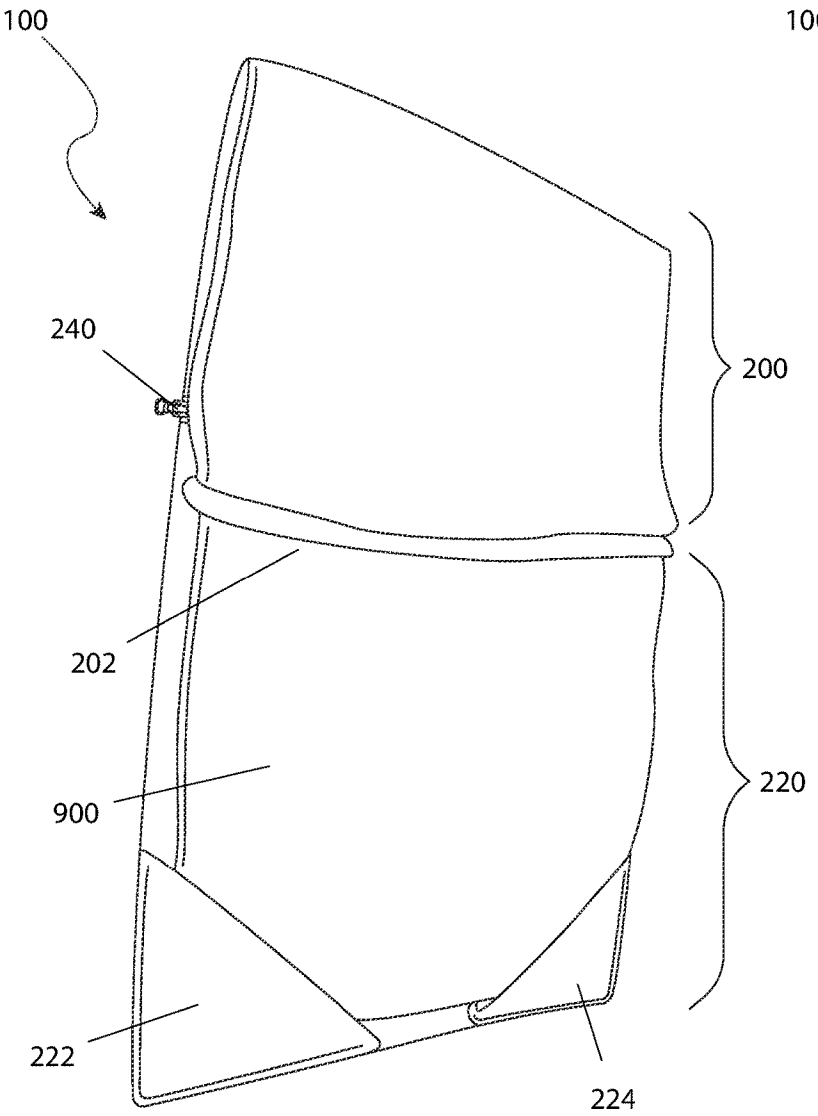
FIG. 1 is an isometric view of a blanket cozy 100, according to an embodiment of the present device.
Figure 4:
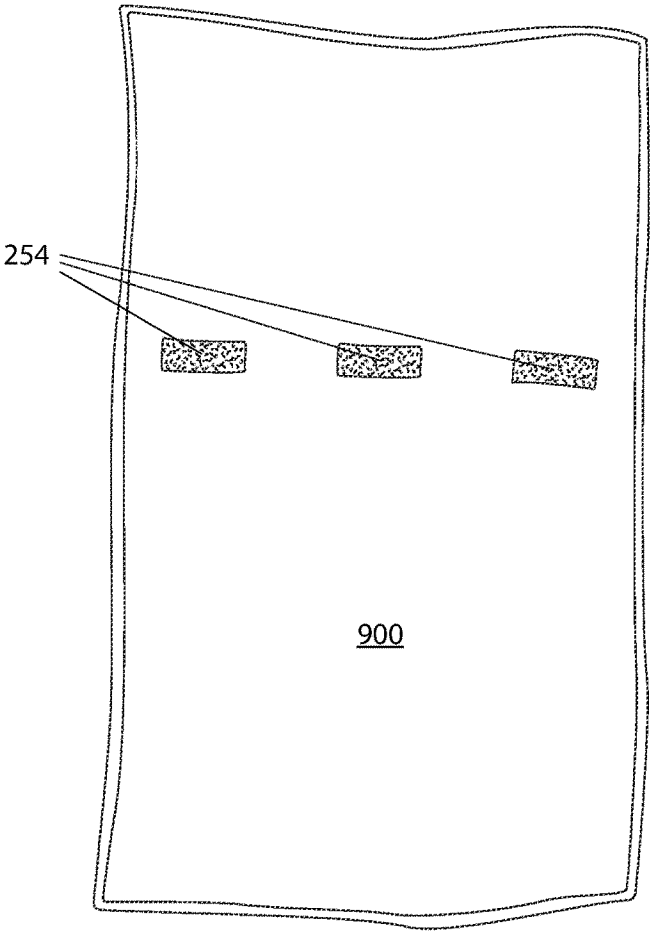
Figure 3:
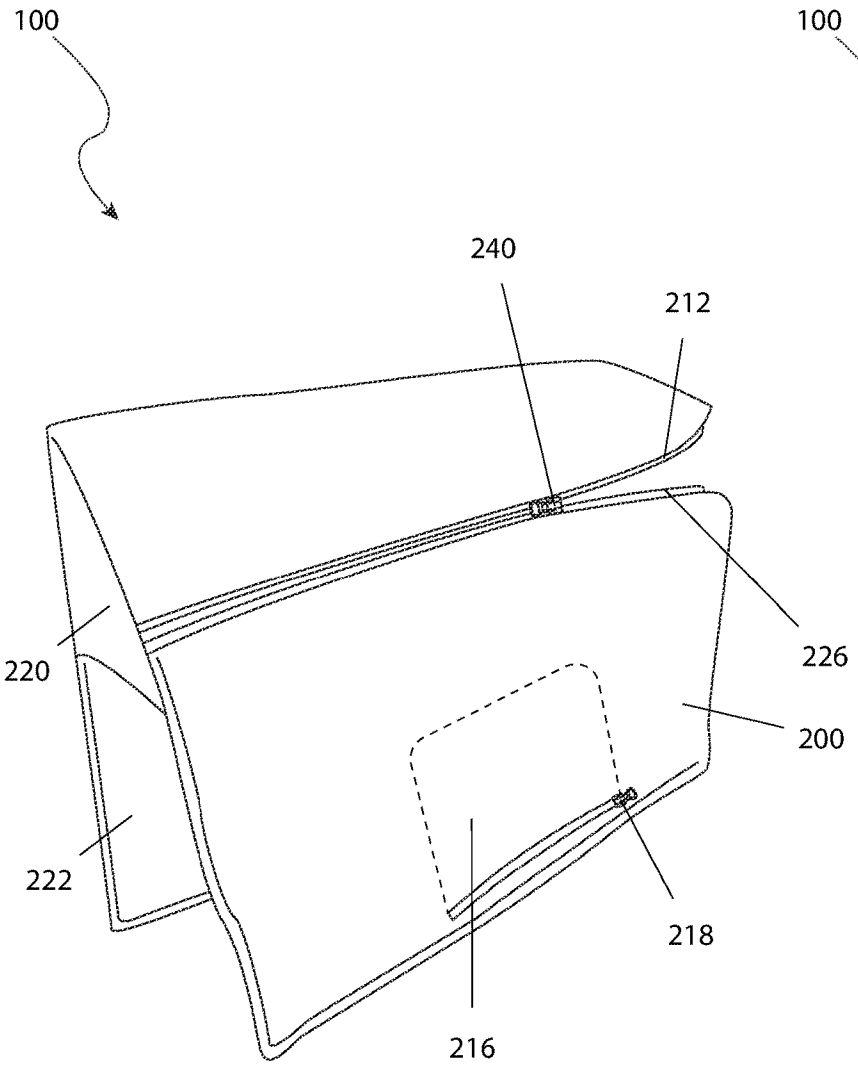
FIG. 3 is an isometric view of a blanket cozy 100, according to an embodiment of the present device, illustrating the sheet top portion 200 folded forward to show the separating zipper 240; and, FIG. 4 is a view of a blanket cozy 100, according to an embodiment of the present device, illustrating the loop portion 254 of the one or more hook and loop fasteners applied to the quilt 900.

100 blanket cozy
200 sheet top portion
202 quilt pocket
210 rear panel
212 first zipper half
214 front panel
216 personal items pocket
218 personal items zipper
220 sheet bottom portion
222 left corner pocket
224 right corner pocket
226 second zipper half
230 first leg
232 second leg
234 hypotenuse
240 separating zipper
252 hook portion
254 loop portion
900 quilt 1. Description of the Device The present blanket cozy is directed to a blanket cozy (herein described as the "device") 100. The blanket cozy 100 may comprise a sheet top portion 200, a sheet bottom portion 220, and a separating zipper 240. The sheet top portion 200 and the sheet bottom portion 220 may form a protective sheet for use on a bed. The protective sheet may be configured to hold a quilt 900, blanket, and/or other bedding in place and to prevent the top of the quilt 900 from becoming soiled by a user. The sheet top portion 200 may comprise a quilt pocket 202 configured to cover and retain the top of the quilt 900. The sheet bottom portion 220 may comprise a left corner pocket 222 and a right corner pocket 224 configured to retain the bottom of the quilt 900. The sheet top portion 200 may be detached from the sheet bottom portion 220 at the separating zipper 240 for laundering and/or replacement to change the appearance of the protective sheet.

The sheet top portion 200 may be a rectangular fabric panel that may be folded in half to define a rear panel 210 and a front panel 214. The lateral edges of the rear panel 210 and the front panel 214 may be sewn together to form the quilt pocket 202. An aperture for accessing the interior of the quilt pocket 202 may be defined at the bottom of the sheet top portion 200 along the edge that is neither folded nor sewn. The top of the quilt 900 may be pushed into the quilt pocket 202 to retain and protect the top of the quilt 900.

A first zipper half 212 of the separating zipper 240 may be coupled to the bottom of the rear panel 210. The first zipper half 212 may be covered by a flap of material that extends past the first zipper half 212 to prevent the first zipper half 212 from contacting the user.

The top rear of the sheet top portion 200 may comprise a personal items pocket 216. The personal items pocket 216 may be an internal cavity configured to store one (1) or more personal items. As a non-limiting example, the personal items may comprise a smartphone. A personal items zipper 218 may secure the personal items within the personal items pocket 216.

In some embodiments, the personal items pocket 216 may be divided into a left side and a right side by an internal sewn wall. Both sides of the personal items pocket 216 may be accessed by opening the personal items zipper 218.

As non-limiting examples, the sheet top portion 200 may be made from silk, faux fur, other soft materials, or any combination thereof recognizing that the sheet top portion 200 may contact a user's face.

The sheet bottom portion 220 may be a rectangular fabric panel. The sheet bottom portion 220 may comprise the left corner pocket 222 at the bottom left corner of the sheet bottom portion 220 and the right corner pocket 224 at the bottom right corner of the sheet bottom portion 220. The left corner pocket 222 may be configured to retain the bottom left corner of the quilt 900 and the right corner pocket 224 may be configured to retain the bottom right corner of the quilt 900.

An individual corner pocket selected from the left corner pocket 222 and the right corner pocket 224 may be a fabric panel in the shape of an isosceles right triangle that may be coupled to the sheet bottom portion 220 along two (2) edges. A first leg 230 of the isosceles right triangle may be sewn to the bottom edge of the sheet bottom portion 220. A second leg 232 of the isosceles right triangle may be sewn to the side edge of the sheet bottom portion 220. A hypotenuse 234 of the isosceles right triangle may run diagonally across the sheet bottom portion 220 separated from the sheet bottom portion 220 and forming the individual corner pocket that may be configured to accept a corner of the quilt 900.

A second zipper half 226 of the separating zipper 240 may be coupled to the top of the sheet bottom portion 220. As non-limiting examples, the sheet bottom portion 220 may be made from cotton, fleece, bamboo, polyester, linen, microfiber, satin, or any combination thereof. The separating zipper 240 may comprise the first zipper half 212 and the second zipper half 226. The separating zipper 240 may detachably couple the sheet top portion 200 to the sheet bottom portion 220. The separating zipper 240 may enable the sheet top portion 200 to be removed from the sheet top portion 200.

In some embodiments, the sheet top portion 200 may be selected from an assortment of materials, colors, designs, or any combination thereof. This may enable a mix and match feature where a first sheet top portion may be removed and replaced by a second sheet top portion to alter the appearance of a bed.

In some embodiments, the blanket cozy 100 may comprise one (1) or more hook-and-loop fasteners. The fasteners may optionally be used to assist in retaining the top of the quilt 900 in the quilt pocket 202. As a non-limiting example, a hook portion 252 of an individual fastener may be coupled to the inside of the quilt pocket 202 on the back side of the front panel 214. A loop portion 254 of an individual fastener may be coupled to the top of the quilt 900 at the position where the hook portion 252 will contact the quilt 900 when the top of the quilt 900 is placed into the quilt pocket 202. The hook portion 252 may engage the loop portion 254 to retain the quilt 900.

In use, a fitted sheet may be placed on a mattress and then the protective sheet may be placed on the fitted sheet. The quilt 900 may be placed on top of the protective sheet. The top of the quilt 900 may be tucked into the quilt pocket 202. The bottom of the quilt 900 may be tucked into the left corner pocket 222 and the right corner pocket 224. The sheet top portion 200 may retain the quilt 900 in place and may protect the top of the quilt 900 from being soiled. Because the sheet top portion 200 may become dirty faster than the sheet bottom portion 220, the sheet top portion 200 may be removed by unzipping the separating zipper 240 and may be laundered or replaced by a different sheet top portion.

The exact specifications, materials used, and method of use of the blanket cozy 100 may vary upon manufacturing. The foregoing descriptions of specific embodiments of the present blanket cozy have been presented for purposes of illustration and description. They are not intended to be exhaustive or to limit the blanket cozy to the precise forms disclosed, and obviously many modifications and variations are possible in light of the above teaching. The embodiments were chosen and described in order to best explain the principles of the blanket cozy and its practical application, to thereby enable others skilled in the art to best utilize the blanket cozy and various embodiments with various modifications as are suited to the particular use contemplated.

What is claimed is:

1. A blanket cozy device comprising:

a sheet top portion;

a sheet bottom portion; and, a separating zipper; and, wherein the sheet top portion and the sheet bottom portion form a protective sheet for use on a bed and, wherein the protective sheet is configured to hold a quilt, blanket, and/or other bedding in place and prevent the top of the quilt from becoming soiled by a user;

wherein the sheet top portion comprises a quilt pocket configured to cover and retain the top of the quilt;

wherein the sheet bottom portion comprises a left corner pocket and a right corner pocket configured to retain the bottom of the quilt;

wherein the sheet top portion is detachable from the sheet bottom portion at the separating zipper for laundering and/or replacement to change the appearance of the protective sheet;

wherein the sheet top portion is a rectangular fabric panel that can be folded in half to define a rear panel and a front panel, with lateral edges sewn together to form the quilt pocket;

wherein the top rear of the sheet top portion comprises a personal items pocket, configured to store one or more personal items;

wherein the personal items pocket is divided into a left side and a right side by an internal sewn wall, accessible by opening the personal items zipper;

wherein the sheet top portion is made from silk or faux fur;

wherein the sheet bottom portion is a rectangular fabric panel comprising the left corner pocket and the right corner pocket, configured to retain the bottom corners of the quilt;

wherein an individual corner pocket from the left corner pocket and the right corner pocket is a fabric panel in the shape of an isosceles right triangle, coupled to the sheet bottom portion along two edges to accept a corner of the quilt;

wherein the sheet bottom portion is made from cotton, fleece, bamboo, polyester, linen, microfiber, or satin; and, wherein the left corner pocket and the right corner pocket are configured to securely hold the bottom corners of the quilt, ensuring it remains in place on the bed.

2. The blanket cozy device of claim 1, wherein the separating zipper comprises a first zipper half coupled to the bottom of the rear panel and covered by a material flap to prevent contact with the user.

3. The blanket cozy device of claim 2, wherein the separating zipper comprises a second zipper half coupled to the top of the sheet bottom portion.

4. The blanket cozy device of claim 1, wherein the separating zipper enables the sheet top portion to be removed from the sheet bottom portion.

5. The blanket cozy device of claim 1, wherein the sheet top portion is available in an assortment of materials, colors, designs, or any combination thereof, allowing for mix and match features to alter the appearance of a bed.

6. The blanket cozy device of claim 1, further comprising one or more hook-and-loop fasteners used to assist in retaining the top of the quilt in the quilt pocket.

7. The blanket cozy device of claim 6, wherein the hook-and-loop fasteners comprise a hook portion coupled to the inside of the quilt pocket and a loop portion coupled to the top of the quilt for engagement and retention.

8. The blanket cozy device of claim 1, wherein the quilt pocket is configured to protect and retain the top of the quilt, preventing it from shifting during use.

* * * * *